United States Patent [19]

Sitler et al.

[11] 4,155,607

[45] May 22, 1979

[54] VERTICAL FILING SYSTEM

[75] Inventors: Richard W. Sitler, Costa Mesa; Sigurd A. Johnson, Glendora, both of Calif.

[73] Assignee: Plan Hold Corporation, Irvine, Calif.

[21] Appl. No.: 878,605

[22] Filed: Feb. 16, 1978

[51] Int. Cl.[2] ..... A47B 63/00; B42F 15/00

[52] U.S. Cl. ..... 312/184; 312/185; 211/46; 211/123

[58] Field of Search ..... 312/183, 184, 185, 234.4; 211/46, 48, 123

[56] References Cited

U.S. PATENT DOCUMENTS

| | | | |
|---|---|---|---|
| 2,188,669 | 1/1940 | Ulrich | 312/184 |
| 2,990,961 | 7/1961 | Schneider | 24/251 |
| 3,165,104 | 1/1965 | Zippel | 312/184 |
| 3,208,457 | 9/1965 | Zippel | 312/184 |
| 3,862,687 | 1/1975 | Pirman | 312/184 |
| 3,891,093 | 6/1975 | Petrie | 211/46 |
| 3,896,526 | 7/1975 | Joiner | 211/48 |
| 3,913,995 | 10/1975 | Malcik et al. | 312/183 |
| 3,994,547 | 11/1976 | Sitler | 312/184 |

FOREIGN PATENT DOCUMENTS

| | | | |
|---|---|---|---|
| 687092 | 5/1964 | Canada | 312/184 |
| 366266 | 12/1962 | Switzerland | 312/184 |

*Primary Examiner*—Victor N. Sakran

*Attorney, Agent, or Firm*—Poms, Smith, Lande, Glenny & Rose

[57] ABSTRACT

A filing system for supporting material to be filed in vertical zones, such material being single sheet material, multiple sheet material held in a binder, vertically arranged horizontally extending pockets or compartments of single or multiple form. A support bar is positioned transversely of the vertical filing zones and supported at opposite ends, the support bar having a longitudinally extending web in a vertical plane normal to said vertical zone and having dihedrally disposed flanges extending from said web along its length in opposite directions. The flanges are shaped to provide upwardly facing bearing contact areas and downwardly facing bearing contact areas spaced from the vertical plane, each downwardly facing contact area being located to be cooperable with an upwardly facing contact area on the opposite side of the vertical plane to provide a set of bearing contact areas for supporting a suspension means connected to the material to be filed. The cross sectional shape of the support bar is adapted to cooperate with a suspension means which utilizes one set of bearing contact areas and also a suspension means which is adapted to utilize two sets of bearing contact means. A support bar which can be readily reinforced against bending. A support bar which has engagement means on its support flanges for cooperation with one of the suspension means for restricting tilting or rocking of the vertically filed material about the support bar.

14 Claims, 11 Drawing Figures

Fig. 5.
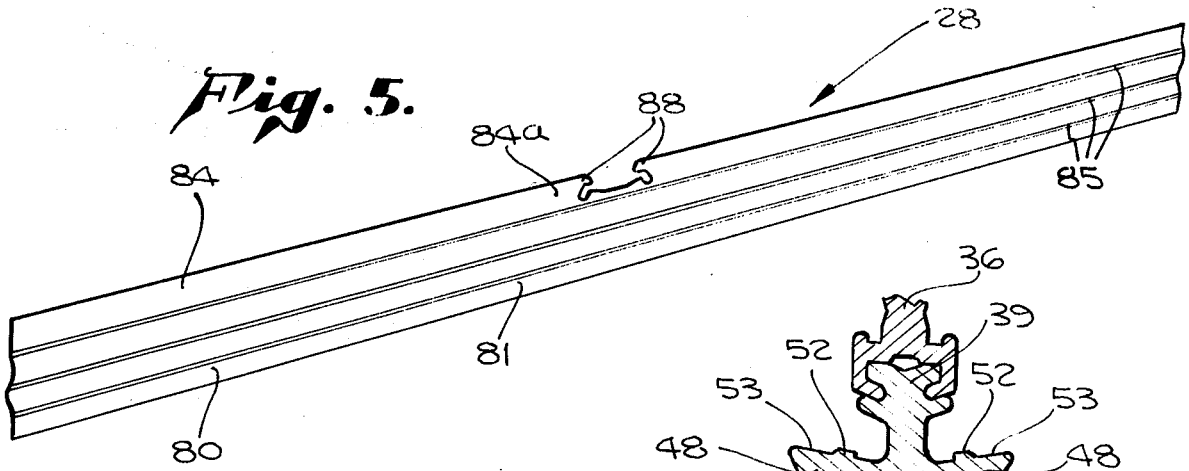
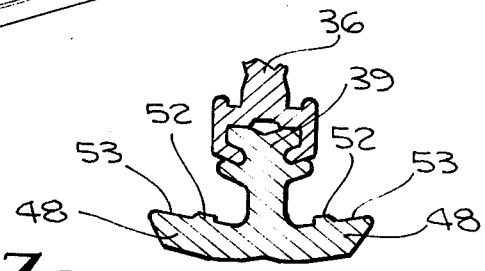
Fig. 7.
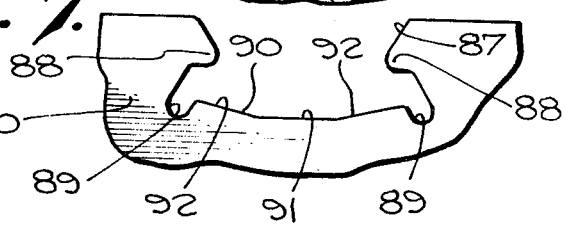
Fig. 6.
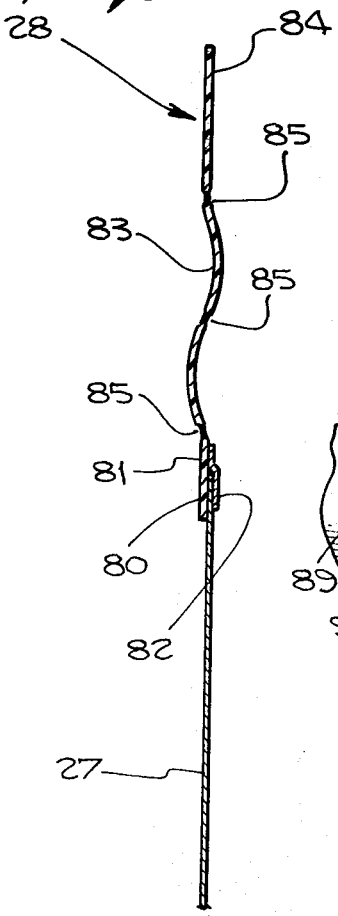
Fig. 8.
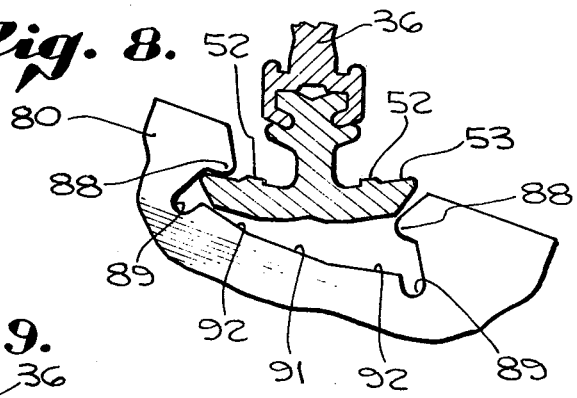
Fig. 9.
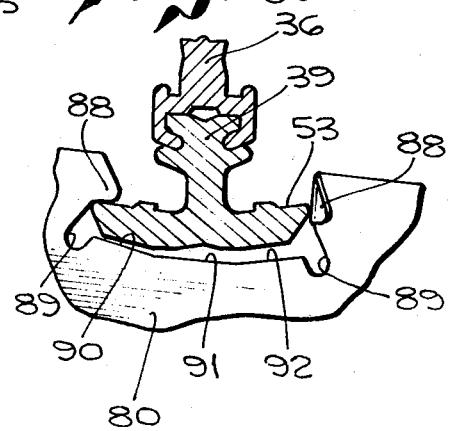
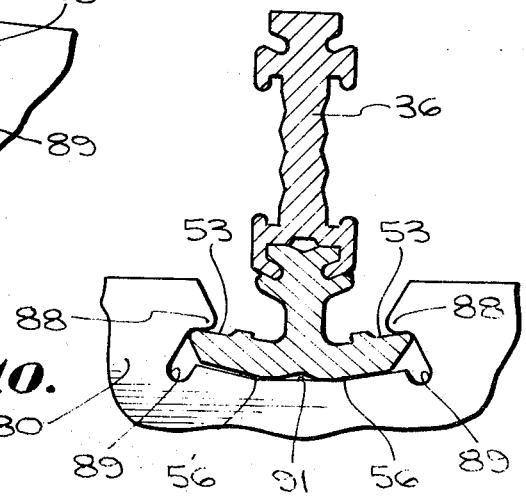
Fig. 10.

VERTICAL FILING SYSTEM

BACKGROUND OF THE INVENTION

Sheet material of relatively large dimension and area, such as engineering drawings, blueprints, building and construction specifications, maps, charts, and various other types of drawings and printed matter are relatively difficult to file. Several prior methods of filing such sheet material have included vertical suspension of individual sheets from a horizontal crossbar, vertical suspension of multiple sheets held in a friction binder from a horizontal support bar, a vertical arrangement of square section compartments in which the sheet material was rolled into a cylinder and inserted in a compartment, and filing such sheet material in a flat horizontal drawer. Often the support bar was provided in a cabinet construction, the support bar being either fixed in its location in the cabinet or being mounted on a tracking mechanism which would permit the support bar to be moved outwardly toward the cabinet opening to facilitate disengagement and engagement of the vertically suspended material with the support bar.

One example of a cabinet construction for vertical filing of sheet material is described in my U.S. Pat. No. 3,994,547 in which the support bar is provided with a configuration which so mates with a configuration on a suspension means that the sheet material may be moved horizontally into interengagement with the support bar and held in level horizontal position.

There have been numerous configurations of support bars and suspension members for hanging sheet material in vertical planes and for attempting to hold the sheet material in level position while at the same time attempting to facilitate engagement and disengagement of the suspension member with the support bar. Such numerous constructions are described and shown in the following patents: Austrian Pat. No. 226,195; Austrian Pat. No. 229,265; German Pat. No. 1,110,136; Zippel Pat. Nos. 3,208,457, 3,275,004; Stillwell U.S. Pat. No. 1,066,543; Butts U.S. Pat. No. 3,890,197; Johansson U.S. Pat. No. 3,666,226; German Pat. No. 1,126,356.

In addition, it was sometimes found to be desirable to provide a support bar configuration having multipurposes; that is, the ability to support different types of vertical filing systems. For example, it was desired that a single cabinet with a support bar therein be adapted for use for vertical filing of multiple sheets of material held in a binder, single sheets of material, and the suspension from the bar of multicompartmented vertically arranged filing structures for roll stored drawings. Thus, the configuration of the support bar was characterized by its adaptability to different types of vertical filing. Different filing systems, as mentioned above, also created load problems on the support bar and such a multipurpose support bar was required to be sufficiently strong to reduce to a minimum bending of the bar between its support points. It will be understood that such a support bar may support as much as 750 lbs. or more of sheet material.

SUMMARY OF INVENTION

The present invention relates to a vertical filing system for supporting material to be filed in vertical zones within or without a cabinet construction and in which many of the disadvantages of prior proposed constructions are avoided. The present invention particularly relates to a novel construction of a support means which is adapted to be cooperable with single point and dual point suspension means of novel form.

An object of the present invention is to provide a vertical filing system in which a support bar means has a configuration for interengagement with a suspension means connected to a suspended sheet in such a manner that it may be readily assembled and disassembled with the support bar.

Another object of the invention is to provide a multipurpose support bar including a vertical web and oppositely directed flanges disposed at a selected dihedral angle to facilitate engagement and maintenance of such engagement of a suspension means assembled therewith.

A still further object of the invention is to provide a novel support bar wherein said flanges are provided with an interlock rib cooperable with a recess on a suspension means for securely retaining a suspension means in assembly therewith.

A specific object of the invention is to provide a novel support bar having flanges arranged at a selected dihedral angle wherein a flange on one side of the vertical web is provided with an upwardly facing bearing contact area and the flange on the opposite side of said web is provided with a downwardly facing bearing contact area cooperable with a suspension means of selected configuration to maintain the suspended material in horizontal relation and adapted to cooperate with at least two different types of configuration of suspension means.

Various other objects and advantages of the present invention will be readily apparent from the following description of the drawings in which exemplary embodiments of the invention are shown.

In the Drawings:

FIG. 5 shows a perspective view of a suspension means for a single sheet of material.

FIG. 6 is an enlarged fragmentary sectional view of the suspension means as shown in FIG. 5.

FIG. 7 is a sectional view of the support bar shown in FIG. 2 and a suspension means of FIG. 5 in its approach to the support bar for assembly therewith.

FIG. 8 is a fragmentary sectional view of said support bar and suspension means of FIG. 7 showing a further step in assembly thereof.

FIG. 9 is a fragmentary view showing flexing of a nose portion of the suspension means of FIG. 5 during assembly thereof with the support bar.

FIG. 10 is a fragmentary view of the support bar and suspension means of FIG. 5 in final assembled relationship.

Figure 1:
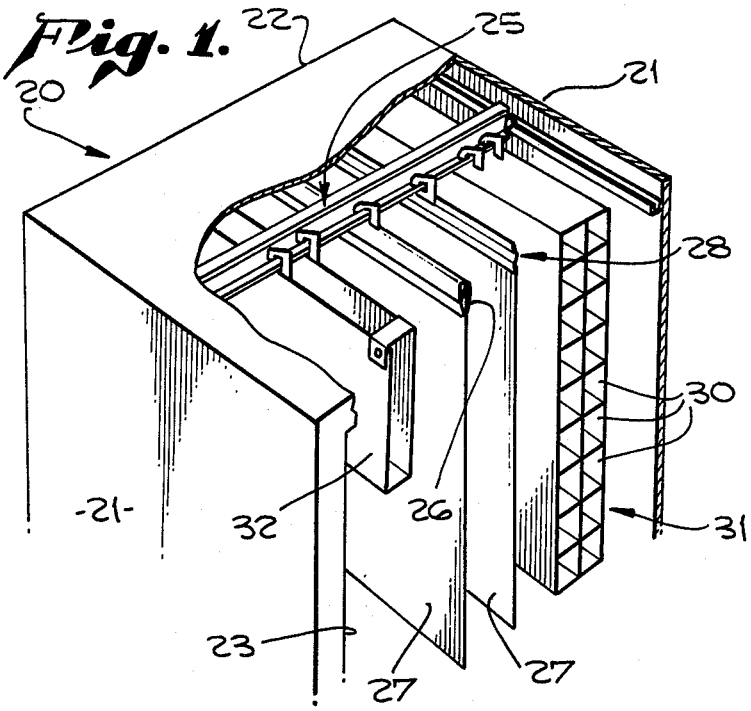
FIG. 1 is a perspective view of an exemplary cabinet construction showing the arrangement of a vertical filing system embodying this invention.

FIG. 1 generally illustrates a cabinet construction equipped with a support means of this invention and illustrating the vertical suspension of a single sheet of material, multiple sheets of material, of a pocket or envelope, and compartments for drawings in roll or tube form. The cabinet construction 20 may be any suitable structure and includes side walls 21, a back wall 22, and a front opening 23 which may be closed by a suitable cabinet door. A top wall for the cabinet construction 20 is partially shown. Within the cabinet construction 20, a support means 25 embodying this invention extends transversely between side walls 21, 21 may be supported in suitable manner from said side walls or from vertical columns associated with the side walls as illustrated in my U.S. Pat. No. 3,994,547. The support means 25 may also be slidably supported from parallel tracks carried by side walls 21 so that the support means 25 may be moved forwardly and rearwardly for more convenient access to the support means 25 when desired. Ends of support means 25 may carry suitable antifriction means such as rollers or slide shoes guided in upwardly facing U-channel tracks or other suitable guide ways carried on side walls 21.

As exemplarily shown in FIG. 1, support means 25 has suspended therefrom a friction binder 26 adapted to carry multiple sheets of material 27. Such a binder may be of a type shown and described in U.S. Pat. No. 2,990,961 or other types of clamping means which engage superimposed edge margins of a plurality of sheets of material such as 27, Such friction binders are often designed to carry 100 sheets or more and a plurality of such binders supported from support means 25 may impose substantial weight upon the support means 25.

In some instances individual separate sheets of material 27 are suspended from support means 25 by affixing along one edge margin of sheet material 27 a strip 28 of suitable material such as plastic material.

Support means 25 may also support one or more vertically arranged compartments 30 defined by a suitable lightweight structure 31 formed from paper board, plastic or other light-weight material. Each compartment 30 may have a polygonal area dimensioned to accommodate sheet material in roll or cylindrical form of preselected diameter. Each of the structures 31 may be independently supported from support means 25.

Support means 25 may also support other types of vertical filing systems as for example an envelope or folded carrier 32 within which may be placed file folders or other material to be contained within the pocket envelope 32.

Figure 2:
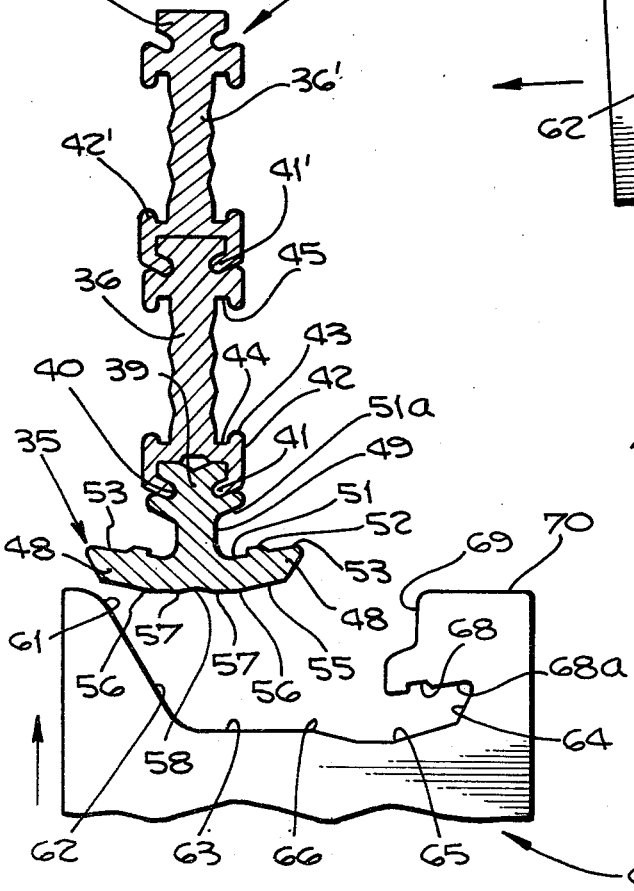
FIG. 2 is a vertical sectional view through a support bar means embodying this invention, together with a fragmentary portion of a suspension means approaching said bar for cooperable engagement therewith.

The example of support means 25 shown in FIG. 2 includes a support bar 35, a reinforcement bar 36, and a second reinforcement bar 36'. The second reinforcement bar 36' is illustrated to show use of a bar having the configuration of bars 36, 36' to vertically stiffen the support means 25 to increase the load carrying capacity of the support means 25. Support means 25 in normal installations may include the support bar 35 and reinforcement bar 36.

Support bar 35 comprises a vertical web 38 having an enlarged longitudinally extending upper portion 39 providing sidewardly opening longitudinal grooves 40 for slideable reception therein of inwardly directed ribs 41 provided on a longitudinally extending lower generally U-section channel portion 42 of reinforcement bar 36. The enlarged portion 42 provides upstanding lips 43 defining upwardly facing grooves 44 cooperable with downwardly facing grooves 45 formed by the enlarged upper longitudinal portion 46 of reinforcement bar 36 to receive mounting clips for supporting the bar on side walls 21 in an exemplary manner as shown in U.S. Pat. No. 3,994,547.

It will be readily apparent that during assembly of support bar 35 and reinforcement bar 36 the bars may be longitudinally slideably engaged by reception of the enlarged portion 39 of bar 35 in the downwardly facing channel of the bar 36. The upper longitudinal portion of bar 36 is configured similarly to that of the enlarged portion 39 of bar 35 and may slideably receive the lower enlarged downwardly facing channel portion 42' of the upper reinforcement bar 36'. Reference numerals with the prime sign are applied to reinforcement bar 36' because its configuration and shape is identical to reinforcement bar 36.

Support bar 35 also includes flanges 48 extending from the lower portion of web 38 on opposite sides of web 38. Oppositely directed support flanges 48 are disposed at a dihedral angle with respect to a vertical plane bisecting web 38 of about 15°. The dihedral angle of 15° has been found more suitable for properly supporting vertically filed material and for cooperation with complementary suspension means as later described.

Support bar 35 provides on each side of a vertical plane bisecting web 38 a longitudinally extending recess 49 configured to generally correspond with a hook portion 50 provided on suspension means. Recess 49 includes approximately parallel top and bottom recess walls **51*a* and 51. Support flange 48 includes a longitudinally extending engagement rib 52 defining by shoulder 52*a* the outer edge of recess wall 51 and also defining a bearing contact area 53 outwardly of rib 52** for cooperation with suspension means as later described.

Bottom surfaces 55 of support flanges 48 may lie generally parallel to the wall 51 and contact area 53 and form a bearing contact area having a ridge 56 defined by surface 57 angularly disposed with respect to surface 55 and forming with the corresponding surface 57 of the adjacent support flange 48 an inverted V-shaped valley 58 at the vertical plane bisecting web 38.

Support flanges 48 thus provide spaced bearing contact areas 53 on their upper faces and on their bottom faces spaced bearing contact areas or ridges 56. A set of contact areas comprising one contact area 53 and the ridge 56 on the opposite side of a vertical plane bisecting web 38 are thus provided for specific cooperation with suspension means of at least two configurations as later described.

Figure 3:
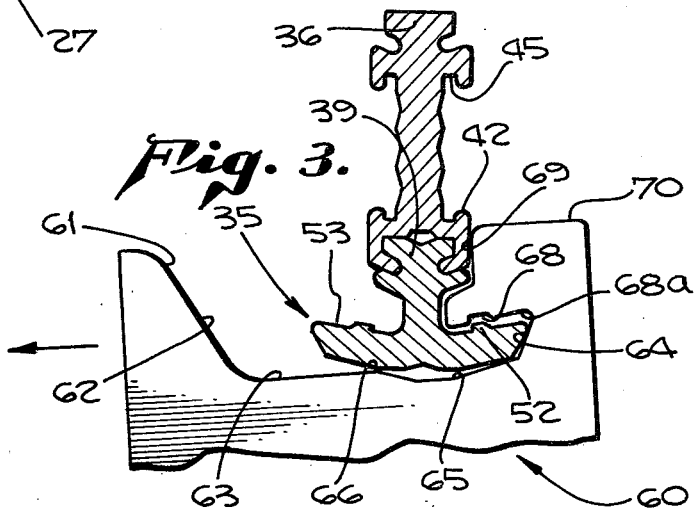
FIG. 3 shows a further step in the engagement of the suspension means with the support bar shown in FIG. 2.
Figure 4:
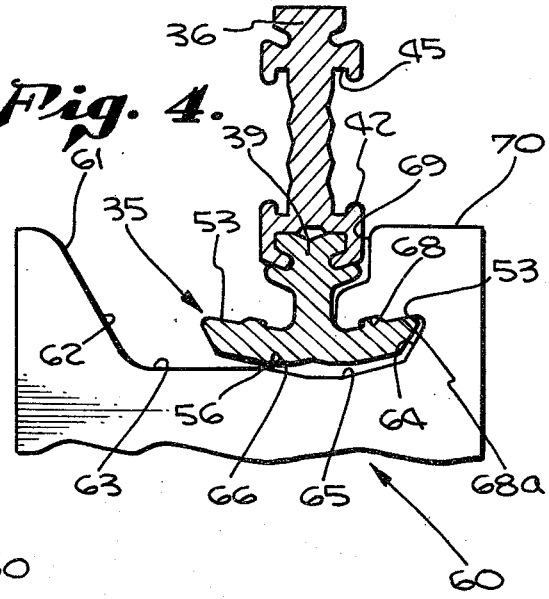
FIG. 4 shows the support bar and suspension means of FIGS. 2 and 3 in final assembled relation.

In the single point suspension means, FIGS. 2–4, generally indicated at 60, which may be utilized in association with exemplary friction binder 26, compartmented tube filing structure 31, and pocket or envelope folder 32, suspension means 60 is configured to cooperate with support bar 35 in a manner which positively restricts rocking or tilting of the vertically filed sheet material in the vertical filing zone. Suspension means 60 may be made of suitable material such as rigid plastic or metal. If metal, it may be stamped from a blank as indicated in U.S. Pat. No. 3,994,547. Suspension means 60 may be secured to friction binder 26 by suitable securing means, such as rivets.

Suspension means 60 provides an upwardly facing opening 61 defined at one side by an inclined edge 62, a bottom edge 63, and a hook portion 50 at the opposite side of the opening. Hook portion 50 defines with bottom edge 63 an upwardly sloping recess 64 adapted to generally correspond to and to receive one of the support flanges 48. Recess 64 has a bottom edge correspondingly configured to bottom surface 55 and the outer portion of flange 48 and includes a shallow concavity 65 having an edge face which joins bottom edge 63 to form a ridge 66 which provides a bearing contact area for engagement with opposed ridge 56 of support flange 48 opposite to that flange 48 received in recess 64. Hook portion 50 has a downwardly facing longitudinally extending groove 68 which is complementary to rib 52 and is adapted to receive rib 52 when suspension means 60 is fully assembled and engaged with support bar 35. Hook portion 50 is further defined by a forehead edge 69 which merges with top edge 70 of suspension means 60. The depth of opening 61 may be slightly greater than the height of support bar 35 so that forehead edge 69 is opposed to and may have abutting contact with enlarged portion 42 of the reinforcement bar 36 to limit rocking and to position hook portion 50 to facilitate assembly and disassembly of the suspension means with the support bar 35.

The support means 25 normally is stationary and the suspension means 60 moves relatively thereto during assembly or hook-like interengagement therewith. In FIG. 2, suspension means 60 is shown in a position below and at the right side of opening 61 such that support bar 35 may readily enter opening 61. As shown in FIG. 3 when the support bar has been fully received within the opening and suspension means 60 is moved laterally thereof, the suspension means is tilted slightly upwardly in order that the hook portion 50 may be received within the hook recess 49 and the extremity of the hook portion passes over the rib 52. As the suspension means is moved toward support bar 35, the forehead edge 69 abuts the enlarged portion 42 of reinforcement bar 36. The suspension means is then in a position to drop the hook portion 50 in hook recess 49 so that the rib 52 is received within recess 68. Slight downward tilting of the suspension means will bring the suspension means and the sheet material carried thereby into level position.

In level position, hook portion 50 is interlocked with the support flange 48 and its bearing contact area 53 is engaged by the suspension member. Also bearing contact area 56 on the opposite flange 48 is in contact with the bearing contact area 66 on the suspension means. In such bearing contact engagement, suspension means 60 is stable and secured on the support means. If the loading of the material carried by the suspension means 60 is uneven, it will be further apparent that the interlocking rib 52 and recess 68 will limit rocking or tilting movement of the suspension means 60. Moreover, disengagement of the single point suspension means with the support means can only be accomplished by first lifting and tilting the suspension means to disengage rib 52 from recess 68 and then tilting the suspension means to withdraw hook portion 50 from recess 49.

The advantages of construction of support bar 35 and single suspension means 60 are several. The selected angle of 15° for the dihedral relation of support flanges 48 provides stable support and facile assembly and disassembly. A smaller angle, for example 5°, could allow disengagement of the suspension means under unbalanced load conditions or when adjacent sheets were being withdrawn and those not being withdrawn were jostled or bumped. A larger angle, for example 25°, would require excessive upward tilting and lifting of the suspension means to engage and disengage the hook portion 50 in the support bar recess 49.

In addition, the longitudinally extending rib 52 on flange 48 cooperates with hook portion 50 of the suspension means to secure the assembly. Weight of the suspended sheet material holds the rib 50 and recess 68 in interlocked engagement and bearing contact area 53, opposed edge 68*a* and bottom bearing contact area 56, 66 maintain the suspended material level or horizontal. Such cooperable engagement facilitates use of the filing system when bar 35 is slidably supported because grasping of one end of a suspension means and pulling the file outwardly will move the bar 35 forwardly for accessibility and more convenient disassembly and later assembly of the bar with the suspension means.

In FIGS. 5–10 inclusive, there is illustrated a modification of the suspension means. In this embodiment, suspension means 28 includes a suspension strip 80 made of suitable flexible plastic material having a cross sectional thickness as minimal as possible, for example 0.015 to 0.025 inches depending upon the length and weight of the sheet material to be secured thereto. Minimal thickness is desired to save space along bar 35 and to increase the filing capacity of the system. A sheet of material 27 may be affixed to strip 80 by any suitable means such as adhesive or adhesive tape applied along a bottom longitudinal edge portion 81 of strip 80 and the upper edge margin 82 of sheet 27. Strip 80 is provided with a relatively shallow S or ogee curve 83 between its bottom edge portion 81 and its upper edge portion 84. At each change in curvature between edge portions 81 and 84, the shallow "S" portion 83 may be longitudinally scored as at 85 to permit flexing or bending about longitudinal score lines 85. The shallow "S" portion 83 provides stiffness and rigidity in its vertical plane when the suspension means 28 is hung from a support bar 35. The plastic material of strip 80 permits flexibility of the strip in two dimensions common to the sheet of material 27 so that the sheet material 27 may be readily passed through a reproduction machine, such as a blueprint machine, for making copies of the drawing or other symbols on the sheet material.

Suspension means 28 includes a dual support configuration at the central upper edge portion 84*a* of strip 80 to permit facile assembly of the suspension means 28 with its attached sheet 27 to support bar 35. As shown in FIG. 7, strip 80 in portion 84 is provided with an opening 87 defined by inwardly extending opposed nose or hook portions 88 which are undercut by diagonally downwardly extending recesses 89 to provide lateral flexibility to nose portions 88. Opening 87 is further defined by a bottom edge 90 having a central flat edge portion 91 and upwardly inclined edge portions 92 which merge with edges of recesses 89. The width of opening 87 (between opposed portions 88) is less than the width of support bar 35 at edge extremities of support flanges 48. Thus, it will be apparent from FIG. 7 that the opening 87 will not receive support bar 35 by movement of opening 87 directly toward flanges 48, nor by tilting of suspension means with respect thereto.

As shown in FIG. 8, a preferred method of assembly of the suspension means 28 with the support bar 35 comprises positioning suspension means 28 at a slight angle so that the remote nose portion 88 may be moved laterally outwardly (that is, towards the right in FIG. 8) to engage nose portion 88 (at the right) with contact bearing area 53 provided on support flange 48. After this engagement of bearing contact area 53 is provided, the lower end of the suspension means may be lifted upwardly to bring the other nose portion 88 (at the right) into engagement with the lower portion of the adjacent support flange 48. Upon further upward pressure applied to suspension means 28, nose portion 88 will twist and yield laterally (FIG. 9) so that the nose portion may be raised slightly above support flange 48 for bearing contact with the bearing contact area 53 on the associated flange 48. As the laterally bent nose portion 88 clears the upper edge of flange 48, it will return to its normal position.

As shown in FIG. 10, suspension means 28 is assembled with support bar 35 and each of the nose portions and opposed edge portion of the opening 87 are in contact engagement with the bearing contact areas 53 and 56 of the support flanges 48. Thus, the suspension means 28 and the sheet of material 27 are held in level position and rocking in the vertical plane of the sheet material is restricted by the interengagement of diagonally opposite bearing contact areas 53, 56 with portions 88 and with edges 92.

Removal of suspension means 28 from support bar 35 is accomplished in virtually reverse manner; that is, by applying downward pressure to one end of suspension means 28 to cause nose portion 88 to laterally flex and twist and pass around the extremity of support flange 48. When nose portion 88 is beneath the extremity of flange 48, the suspension means may be moved rearwardly in the vertical plane or zone of the sheet material to readily disengage the remote nose portion 88 with its supporting flange 48.

Figure 11:
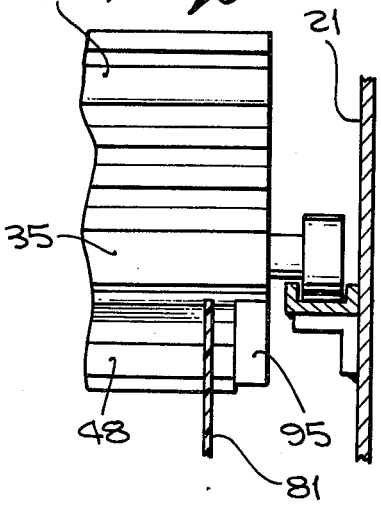
FIG. 11 is a fragmentary elevational view of an end portion of a support bar of this invention showing stop means.

Support means 25 has been illustrated very generally in its manner of support from side walls 21. In some installations, particularly where guide tracks and slides are provided for mounting ends of the support means 25, the connection with the guide means is through the reinforcement bar 36. Under such circumstances, there may be clearance space between the end faces of the support bar means 35 and the end faces of the reinforcement bar 36 with respect to the slide means or other support provided at wall 21. Means to prevent suspension means 28 and attached sheets of material from being pushed off the end of the support bar into such clearance space when the vertical files are shifted along bar 35 may be readily prevented by swaging the two ends of bar 35 for forming thereon end stops 95, FIG. 11. End stop 95 may be provided by lancing and swaging end material of each support flange 48. As suspension means and associated sheets of material 27 are shifted along support bar 35 during insertion and removal of sheets of material, vertical files at the ends of the support bar will be retained on the bar and not be pushed off the bar.

The multipurpose support bar 35 is thus provided with sets of bearing contact areas on upper and lower surfaces of the dihedrally arranged support flanges 48 so that single or dual point suspension means may be readily supported therefrom in a manner which maintains the vertical filing in level positions. Depending upon loads to be carried by bar 35, reinforcement of bar 35 is readily provided by one or more reinforcement bars 36, 36'. The provision of oppositely directed support flanges 48 also facilitates assembly of bar 35 with its end supports because orientation of the bar is not critical.

Various modifications and changes may be made in the vertical filing system described above and all such changes coming within the scope of the appended claims are embraced thereby.

I claim:

1. In a filing system for supporting material to be filed in vertical zones, the combination of:

a support means positioned transversely to said vertical zones and supported at opposite ends;

said support means including a support bar having a longitudinally extending web lying in a vertical plane normal to said vertical zone, and having dihedrally disposed flanges extending from said web along its length and providing a longitudinal valley at said vertical plane for defining ridges spaced from said plane, said flanges being shaped to present upwardly facing bearing contact areas and downwardly facing bearing contact areas spaced from said vertical plane at said ridges, a downwardly facing contact area on one side of said vertical plane being located to be cooperable with an upwardly facing contact area located on the opposite side of said vertical plane to provide a diagonally disposed set of bearing contact areas adapted to cooperate with a suspension means for supporting material to be filed in said vertical zone and maintained in level position.

2. A filing system as claimed in claim 1 wherein said support means includes a reenforcement support member having a web lying in said vertical plane;

and means on said reenforcement member and on said support bar for interconnecting said reenforcement member and said support bar along their length.

3. A filing system as claimed in claim 1 wherein each flange includes longitudinally extending rib-like engagement means at said upwardly facing bearing contact areas.

4. A filing system as claimed in claim 1 including a suspension means adapted to be connected to said material to be filed, said suspension means having at least one set of diagonally disposed bearing contact areas cooperable with a set of bearing contact areas on said support flanges for holding said material and suspension means in level condition.

5. A filing system as claimed in claim 4 wherein each flange includes longitudinally extending upwardly projecting engagement means at said upwardly facing bearing contact areas;

said suspension means including hook means having an engagement recess for reception of said engagement means on said flange to laterally interlock said flange and hook means.

6. A filing system as claimed in claim 5 wherein said support bar is provided with a longitudinally extending recess defined by said web and said flange and configured to correspond to said hook means on said suspension means whereby tilting of said suspension means and material connected thereto is restricted.

7. A filing system as claimed in claim 5 wherein said suspension means includes an upwardly facing opening for reception of said support bar, said upwardly facing opening having a bottom edge with a ridge spaced from said hook means to provide a bearing contact area to form one of the contact areas of a set of bearing contact areas on the suspension means.

8. A filing system as claimed in claim 4 wherein said suspension means includes an opening having a width less than the aggregate width of said flanges on said support bar;

said suspension means being of resilient flexible material;

said opening being defined by opposed hook portions;

at least one of said hook portions being flexible for deflection to accommodate entry of said flanges into said opening below said hook portions.

9. A filing system as stated in claim 8 wherein said suspension means includes a longitudinally extending band adapted to be connected along one longitudinal edge portion to material to be filed;

said longitudinally extending band having a cross section of ogee shape.

10. A filing system as stated in claim 8 wherein the bottom edge of said opening in said suspension means has spaced bearing contact areas, each cooperable with a hook portion diagonally opposite thereto.

11. In a vertical filing system for suspending single sheet, multiple sheet, vertically disposed pockets of single or multiple form, the combination of:

a horizontally extending support bar having a vertical web and having inclined support flanges extending in opposite directions from said web, said vertical web defining a vertical plane of symmetry;

said inclined flanges providing a valley at said plane to define spaced contact areas said web having oppositely directed lateral ribs defining with said support flanges hook shaped recesses on opposite sides of said web extending longitudinally thereof;

a cooperable suspension means adapted to be connected with said material to be filed and including means for attachment to said material to be filed;

an upstanding suspension wall having an upwardly directed opening for reception of said support flanges;

at least one side wall portion of said suspension wall defining said opening having a hook like configuration to define a suspension member recess for reception of at least one of said support flanges;

the bottom edge defining said opening having a bearing contact area for abuttment with a contact area of the support flange on the side of said vertical plane opposite to said suspension member hook portion to limit relative movement in a vertical plane of the suspension member wall with respect to said support bar.

12. A combination as stated in claim 11 wherein at least one of said flanges is provided with an upstanding longitudinally extending engagement rib, and at least one of said hook portions on said suspension means includes a downwardly facing engagement recess for cooperable interengagement with said rib.

13. A combination as stated in claim 11 wherein said suspension member opening includes a pair of hook portions;

said opening in said suspension wall being smaller than the width of said oppositely directed support flanges;

at least one of said hook portions being laterally yieldable for receiving one of said flanges and for snapping said suspension means into assembled relation with the support bar.

14. A combination as stated in claim 13 wherein said one of said hook portions is laterally resilient for bending upon contact with said flange to enlarge said upwardly directed opening for reception of said support flanges.

* * * * *